US012495877B2

(12) United States Patent
Huang et al.

(10) Patent No.: US 12,495,877 B2
(45) Date of Patent: Dec. 16, 2025

(54) STRUCTURE FOR ASSEMBLING DRAW BAR OF DRAW-BAR CASE

(71) Applicant: Jerry Moon, Taipei (TW)

(72) Inventors: He Huang, Dongguan (CN); Liping Yuan, Dongguan (CN); Jerry Moon, Taipei (TW)

(73) Assignee: Jerry Moon, Taipei (TW)

( * ) Notice: Subject to any disclaimer, the term of this patent is extended or adjusted under 35 U.S.C. 154(b) by 119 days.

(21) Appl. No.: 18/632,735

(22) Filed: Apr. 11, 2024

(65) Prior Publication Data

US 2025/0143430 A1 May 8, 2025

(30) Foreign Application Priority Data

Nov. 7, 2023 (CN) ..... 202322995143.8

(51) Int. Cl.
*A45C 13/26* (2006.01)

(52) U.S. Cl.
CPC ..... *A45C 13/262* (2013.01); *A45C 2013/267* (2013.01)

(58) Field of Classification Search
CPC ..... A45C 13/262; A45C 2013/267
See application file for complete search history.

(56) References Cited

U.S. PATENT DOCUMENTS

| | | | | |
|---|---|---|---|---|
| 5,782,325 | A * | 7/1998 | O'Shea | A45C 13/262 16/113.1 |
| 6,176,357 | B1 * | 1/2001 | Kuo | A45C 13/262 190/115 |
| 6,502,677 | B1 * | 1/2003 | Tiramani | A45C 5/14 190/117 |
| 8,783,432 | B2 * | 7/2014 | Wang | A45C 5/03 190/18 R |
| 9,894,971 | B2 * | 2/2018 | Scicluna | A45C 13/262 |
| 11,019,895 | B2 * | 6/2021 | Zhu | A45C 5/03 |

* cited by examiner

*Primary Examiner* — Tri M Mai
(74) *Attorney, Agent, or Firm* — Rabin & Berdo, P.C.

(57) ABSTRACT

The present invention provides a structure for assembling a draw bar of a draw-bar case, which includes a case body and a drawbar mechanism. The draw-bar mechanism includes a draw bar, an upper fixing assembly, and a lower fixing assembly. The draw bar includes a handle, two movable rods, and two guiding sleeves. The upper fixing assembly includes an external fixing plate and a first internal fixing plate. The case body is provided with an accommodating groove. The external fixing plate is penetrated to form two guiding holes. The accommodating groove is penetrated to form two through holes. The first internal fixing plate is disposed in the case body for connecting the external fixing plate. The lower fixing assembly includes a second internal fixing plate forming two positioning holes and several external fixing strips connecting to the second internal fixing plate. A bottom end of the guiding sleeve is installed onto the positioning hole.

5 Claims, 8 Drawing Sheets

STRUCTURE FOR ASSEMBLING DRAW BAR OF DRAW-BAR CASE

FIELD OF THE INVENTION

The present invention relates to the technical field of draw-bar cases, and in particular to a structure for assembling a draw bar of a draw-bar case.

BACKGROUND OF THE INVENTION

A draw-bar case is a suitcase having a draw bar and casters and is widely used because of its ease of use. The draw bar of an existing draw-bar case is basically installed on the case body through screws. The installation process is cumbersome, requires a large amount of labor for workers, and has high labor cost and low production efficiency.

SUMMARY OF THE INVENTION

The problem to be solved by the present invention is to provide a structure for assembling a draw bar of a draw-bar case, which reduces the assembling difficulty, saves manpower, and improves assembling efficiency.

To solve the aforementioned technical problems, the present invention provides a structure for assembling a draw bar of a draw-bar case, which includes a case body and a drawbar mechanism. The drawbar mechanism includes a draw bar, an upper fixing assembly, and a lower fixing assembly. The draw bar includes a handle, a movable rod connected to both ends of the handle, and a guiding sleeve sleeved on the movable rod. The upper fixing assembly includes an external fixing plate and a first internal fixing plate. A surface of the case body is provided with an accommodating groove that matches the external fixing plate. The external fixing plate is disposed on the accommodating groove. Both sides of the external fixing plate are each provided with a guiding hole that runs through the external fixing plate and matches the guiding sleeve. Both sides of the accommodating groove are each penetrated to form with a through hole that is disposed corresponding to the guiding hole. A bottom end of the guiding sleeve extends to an inside of the case body through the through hole and the guiding hole. The first internal fixing plate is disposed in the case body and connected to the external fixing plate in a snap-fitting manner through a wall face of the accommodating groove. The lower fixing assembly includes a second internal fixing plate disposed in the case body and several external fixing strips disposed on an outside of the case body. Both sides of the second internal fixing plate are each provided with a positioning hole that is disposed corresponding to the guiding sleeve. A bottom end of the guiding sleeve is inserted and installed onto the positioning hole. The external fixing strip is connected to the second internal fixing plate in a snap-fitting manner through a wall surface of the case body.

Preferably, the external fixing plate includes a first base plate that matches in shape with the accommodating groove, and a first side plate connected to one side of the first base plate. Several first inverted buckles are disposed in parallel on an inner side surface of the the first side plate. A bottom surface of the first base plate is adjacent to an inner side wall of the accommodating groove. A surface of the case body is provided with an avoidance groove communicated with the accommodating groove. The first side plate is disposed on the avoidance groove. A wall surface of the avoidance groove is penetrated to form a first through hole that is disposed corresponding to the first inverted buckle. The first internal fixing plate comprises a second base plate that matches in shape with an outer wall face of the accommodating groove and a second side plate connected to one side of the second base plate. A top face of the second base plate is adjacent to the outer wall surface of the accommodating groove. The second side plate is penetrated to form a first buckle groove that is disposed corresponding to the first through hole. The first inverted buckle is snap-fitted onto the first buckle groove after passing through the first through hole.

Preferably, the second internal fixing plate includes a third base plate that matches in shape with an inner wall surface of the case body, and connecting portions symmetrically disposed on both sides of the third base plate. The positioning hole is disposed on a top of the connecting portion. Both ends of an inner side surface of the external fixing strip are each provided with a second inverted buckle. The wall surface of the case body is provided with a second through hole that runs through the wall surface and is disposed corresponding to the second inverted buckle. The third base plate is provided with a second buckle groove that runs through the third base plate and is disposed corresponding to the second through hole. The second inverted buckle is snap-fitted on the second buckle groove after passing through the second through hole.

Preferably, two sides of the first base plate are each provided with a guiding groove body. The accommodating groove is provided with a horizontal through groove that runs through the accommodating groove and extends onto the avoidance groove. The guiding groove body is disposed on the horizontal through groove. Both sides of a top of the second base plate are each concavely provided with a horizontal pushing groove extending onto the second side plate. The horizontal pushing groove is disposed as matching with the guiding groove body. The guiding groove body is movably disposed on the horizontal pushing groove. A bottom of the guiding groove body is provided with a strip-shaped guiding groove that runs through the guiding groove body. A top of the horizontal pushing groove is provided with a guiding plate that is disposed as matching with the strip-shaped guiding groove. The guiding plate is movably disposed on the strip-shaped guiding groove. A top of the guiding plate is provided with a position-limiting plate. The position-limiting plate is movably disposed in the guiding groove body.

Preferably, both sides of a bottom of the first base plate are each provided with a position-limiting sleeve that is disposed as matching with the through hole, the guiding hole is internally communicated with the position-limiting sleeve, and the position-limiting sleeve is disposed in the through hole.

The beneficial effects of the present invention are that: the present invention provides a structure for assembling a draw bar of a draw-bar case. In a first step, the lower fixing assembly is assembled onto the case body, and the second internal fixing plate and the external fixing strip are snap-fitted together from the inside and outside of the case body respectively, so that the wall surface of the case body is sandwiched between the second internal fixing plate and the external fixing strip, thereby positioning the second internal fixing plate in the case body. In a second step, the upper fixing assembly is assembled onto the case body, and firstly the external fixing plate is assembled into the accommodating groove so that the guiding hole is aligned with the respective through hole, and then the first internal fixing plate is closed onto the outer wall surface of the accommodating groove from the inside of the case body, so that the external fixing plate and the first internal fixing plate are snap-fitted together, and thus the wall surface of the case body will be sandwiched between the external fixing plate and the first internal fixing plate, thereby positioning the external fixing plate on the accommodating groove. At this time, the guiding hole, the through hole, and the positioning hole will correspond to each other. In a third step, two guiding sleeves of the draw bar are respectively inserted and installed into the respective positioning holes through the guiding hole and through hole on the respective side to complete the assembling of the draw bar. Its structure is simple and the assembling process is convenient without using a large number of screws to assemble the draw bar, which reduces the assembling difficulty, saves manpower, reduces labor cost, and improves production efficiency.

DETAILED DESCRIPTION OF THE PREFERRED EMBODIMENTS

In order to make the objectives, technical solutions and advantages of the embodiments of the present disclosure more clear, the technical solutions of the embodiments of the present disclosure will be described clearly and completely in connection with the accompanying drawings of the embodiments of the present disclosure. Obviously, the described embodiments are some, but not all, of the embodiments of the present disclosure.

Based on the described embodiments of the present disclosure, all other embodiments obtained by those of ordinary skills in the art without creative efforts fall within the claimed scope of the present disclosure.

Figure 1:
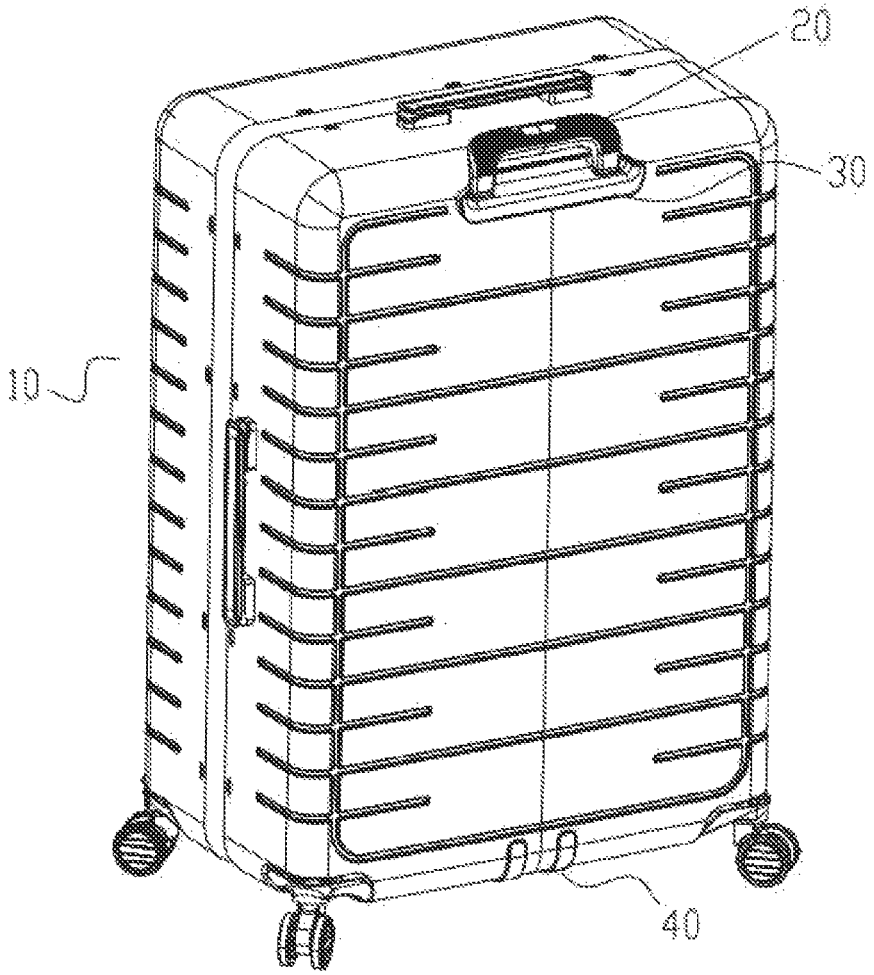
FIG. 1 illustrates a schematic diagram of the appearance structure of the present invention.
Figure 2:
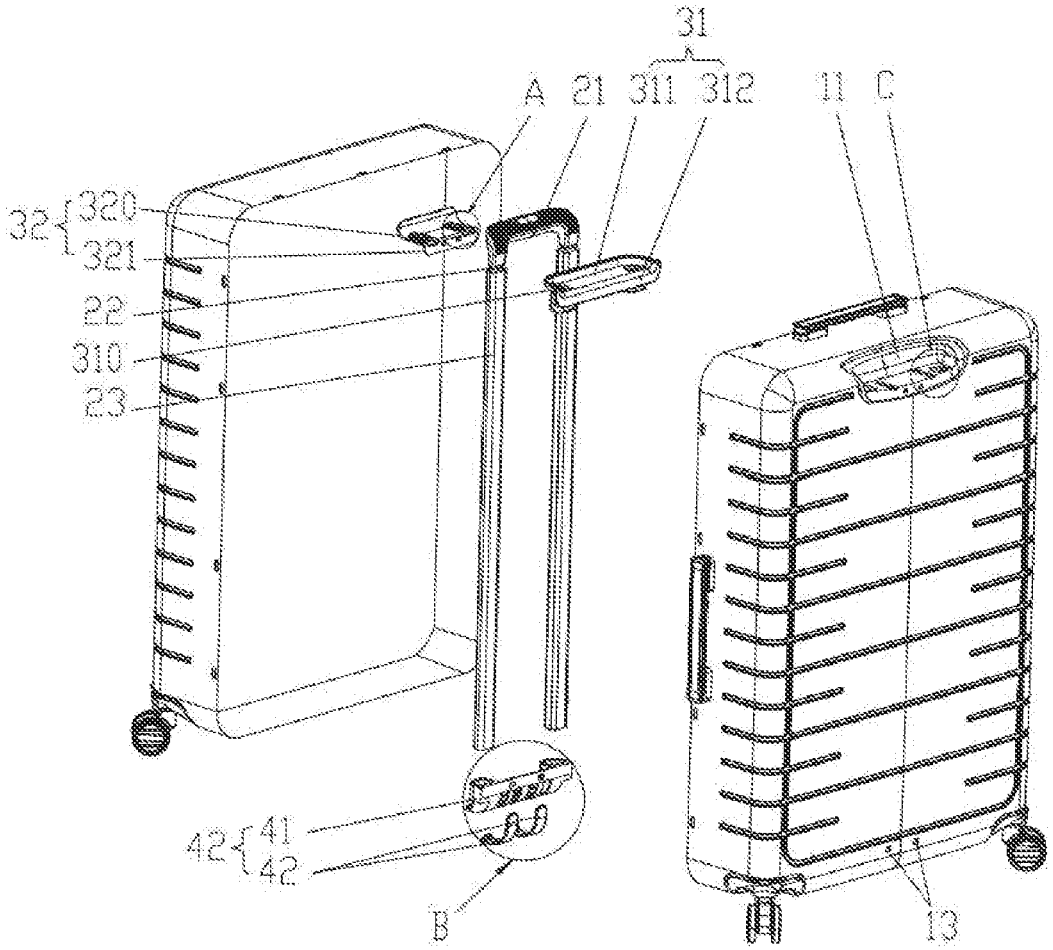
FIG. 2 illustrates a schematic exploded diagram of the structure of the present invention.
Figure 3:
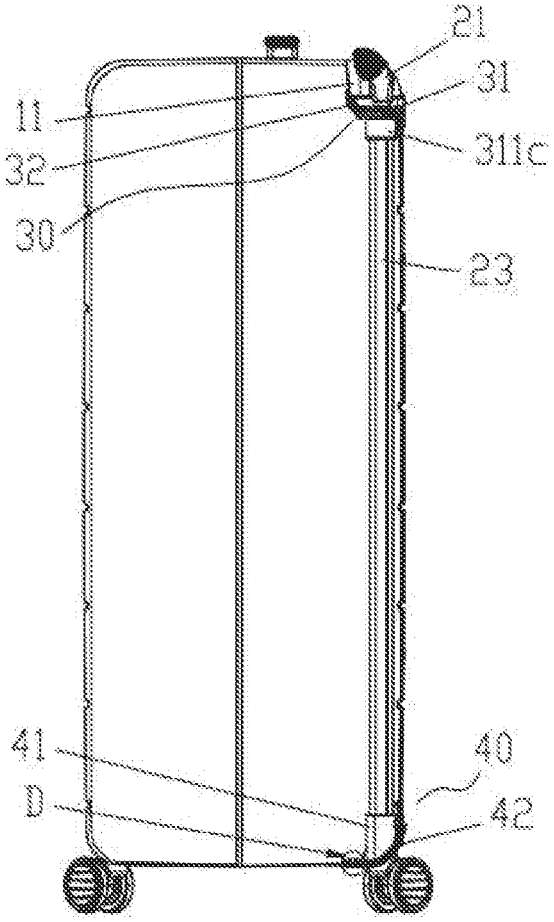
FIG. 3 illustrates a cross-sectional view of the present invention.
Figure 4:
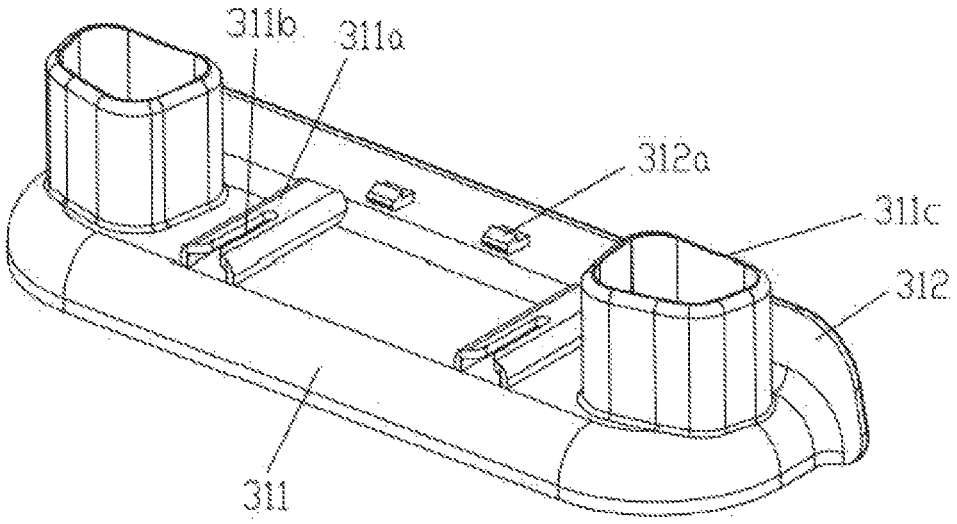
FIG. 4 illustrates a schematic structural diagram of an external fixing plate of the present invention.
Figure 5:
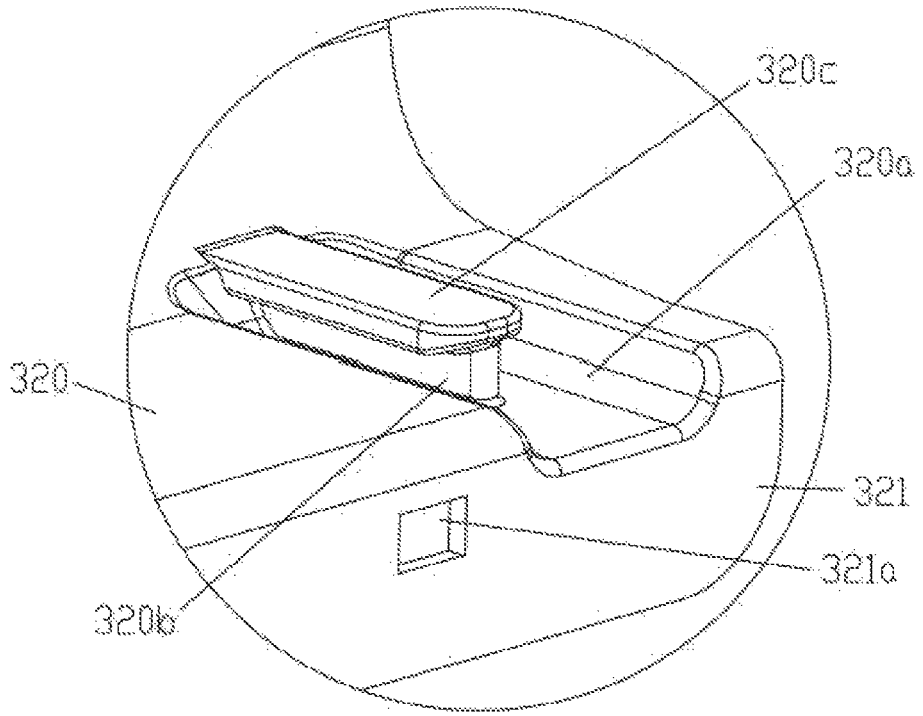
FIG. 5 illustrates a schematic partial enlarged structural diagram of part A in FIG. 2 of the present invention.
Figure 6:
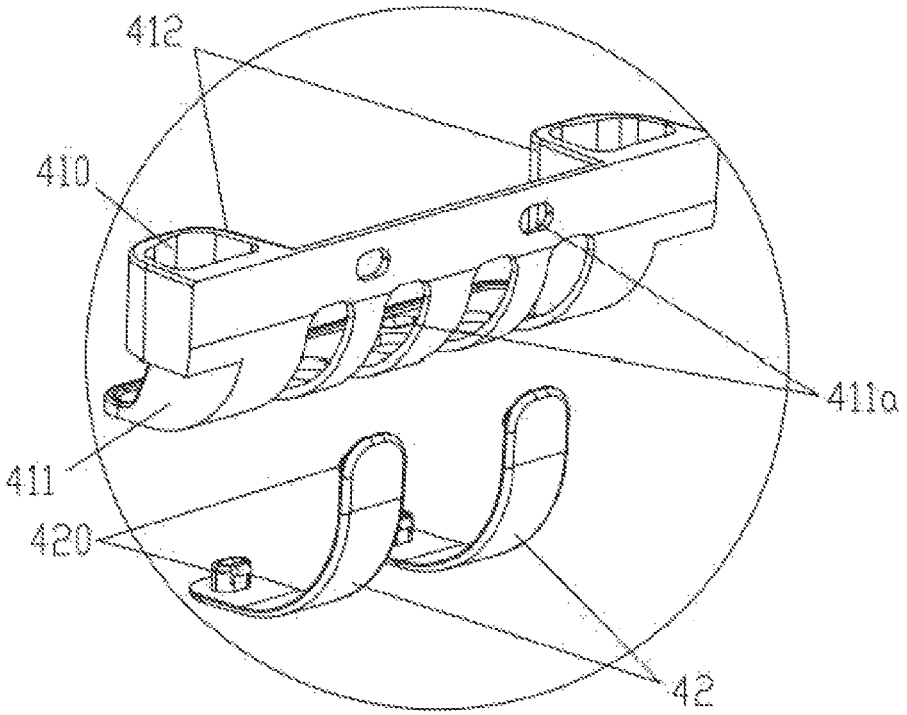
FIG. 6 illustrates a schematic partial enlarged structural diagram of part B in FIG. 2 of the present invention.
Figure 7:
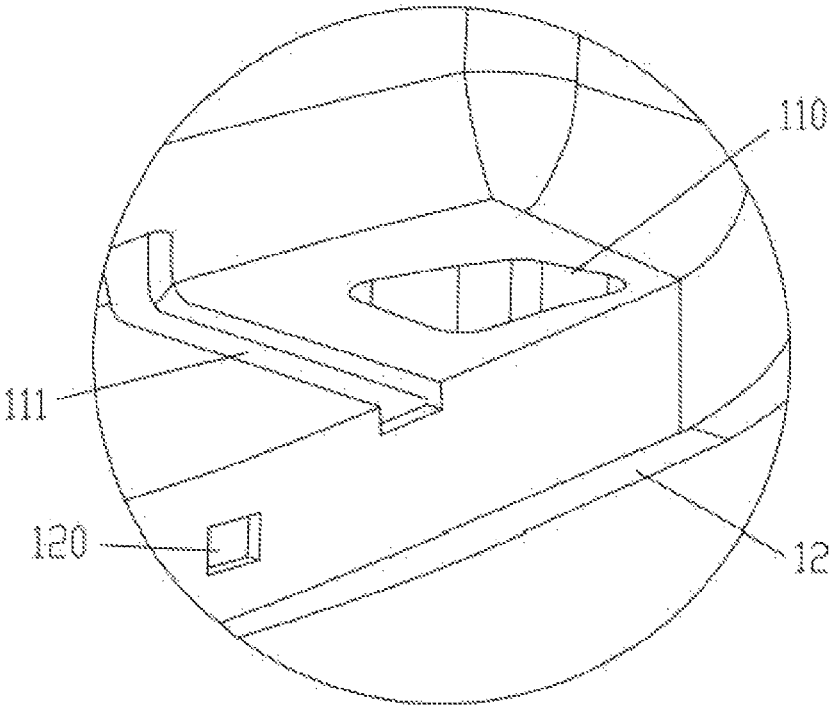
FIG. 7 illustrates a schematic partial enlarged structural diagram of part C in FIG. 2 of the present invention.
Figure 8:
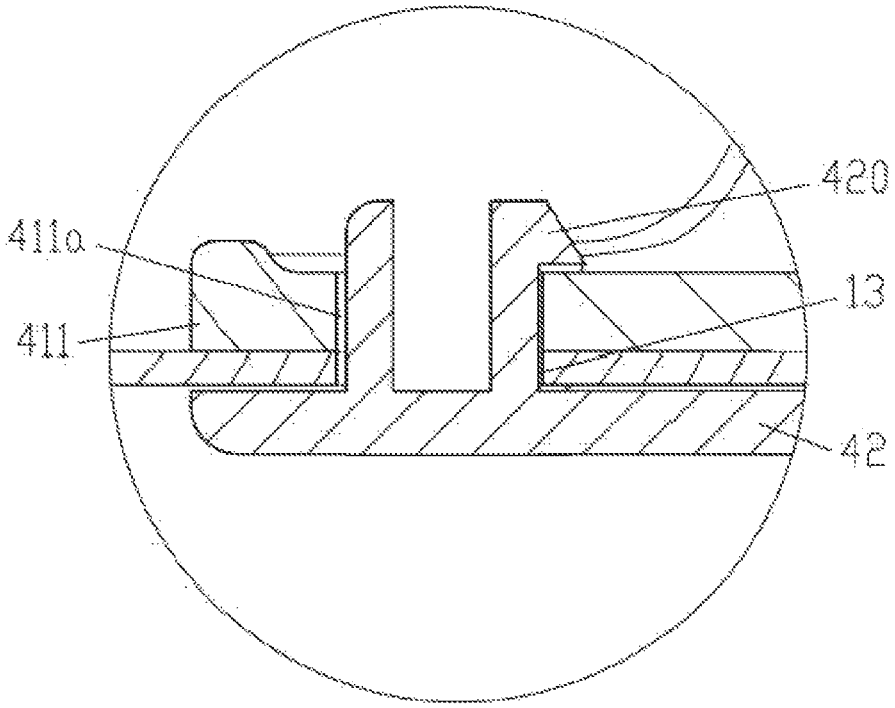
FIG. 8 illustrates a schematic partial enlarged structural diagram of part D in FIG. 3 of the present invention.

Referring to FIGS. 1-8, the present invention provides a structure for assembling a draw bar of a draw-bar case, which includes a case body 10 and a drawbar mechanism. The drawbar mechanism includes a draw bar 20, an upper fixing assembly 30, and a lower fixing assembly 40. The draw bar 20 includes a handle 21, a movable rod 22 connected to both ends of the handle 21, and a guiding sleeve 23 sleeved on the movable rod 22. The upper fixing assembly 30 includes an external fixing plate 31 and a first internal fixing plate 32. A surface of the case body 10 is provided with an accommodating groove 11 that matches the external fixing plate 31. The external fixing plate 31 is disposed on the accommodating groove 11. Both sides of the external fixing plate 31 are each provided with a guiding hole 310 that runs through the external fixing plate and matches the guiding sleeve 23. Both sides of the accommodating groove 11 are each provided with a through hole 110 that runs through the accommodating groove and is disposed corresponding to the guiding hole 310. A bottom end of the guiding sleeve 23 extends to an inside of the case body 10 through the through hole 110 and the guiding hole 310. The first internal fixing plate 32 is disposed in the case body 10 and connected to the external fixing plate 31 in a snap-fitting manner through a wall surface of the accommodating groove 11. The lower fixing assembly 40 includes a second internal fixing plate 41 disposed in the case body 10 and several external fixing strips 42 disposed on an outside of the case body 10. Both sides of the second internal fixing plate 41 are each provided with a positioning hole 410 that is disposed corresponding to the guiding sleeve 23. The bottom end of the guiding sleeve 23 is inserted and installed onto the positioning hole 410. The external fixing strip 42 is connected to the second internal fixing plate 41 in a snap-fitting manner through a wall surface of the case body 10.

Its working principle is that: in a first step, the lower fixing assembly 40 is assembled onto the case body 10, and the second internal fixing plate 41 and the external fixing strip 42 are snap-fitted together from the inside and outside of the case body 10 respectively, so that the wall surface of the case body 10 is sandwiched between the second internal fixing plate 41 and the external fixing strip 42, thereby positioning the second internal fixing plate 41 in the case body 10. In a second step, the upper fixing assembly 30 is assembled onto the case body 10, and firstly the external fixing plate 31 is assembled into the accommodating groove 11 so that the guiding hole 310 is aligned with the respective through hole 110, and then the first internal fixing plate 32 is closed onto an outer wall surface of the accommodating groove 11 from an inside of the case body 10, so that the external fixing plate 31 and the first internal fixing plate 32 are snap-fitted together, and thus the wall surface of the case body 10 will be sandwiched between the external fixing plate 31 and the first internal fixing plate 32, thereby positioning the external fixing plate 31 on the accommodating groove 11. At this time, the guiding hole 310, the through hole 110, and the positioning hole 410 will correspond to each other. In a third step, two guiding sleeves 23 of the draw bar 20 are respectively inserted and installed into the respective positioning holes 410 through the guiding hole 310 and through hole 110 on the respective side to complete the assembling of the draw bar 20. Its structure is simple and the assembling process is convenient without using a large number of screws to assemble the draw bar, which reduces the assembling difficulty, saves manpower, reduces labor cost, and improves production efficiency.

Based on the aforementioned embodiments, the external fixing plate 31 includes a first base plate 311 that matches in shape with the accommodating groove 11, and a first side plate 312 connected to one side of the first base plate 311. Several first inverted buckles **312*a* are disposed in parallel on an inner side surface of the the first side plate 312. A bottom surface of the first base plate 311 is adjacent to an inner side wall of the accommodating groove 11. The surface of the case body 10 is provided with an avoidance groove 12 communicated with the accommodating groove 11. The first side plate 312 is disposed on the avoidance groove 12. The wall surface of the avoidance groove 12 is provided with a first through hole 120 that runs through the wall surface and is disposed corresponding to the first inverted buckle 312*a*. The first internal fixing plate 32 includes a second base plate 320 that matches in shape with an outer wall surface of the accommodating groove 11 and a second side plate 321 connected to one side of the second base plate 320. A top surface of the second base plate 320 is adjacent to the outer wall surface of the accommodating groove 11. The second side plate 321 is provided with a first buckle groove 321***a* that runs through the second side plate and is disposed corresponding to the first through hole 120. The first inverted buckle 312*a* is snap-fitted onto the first buckle groove 321*a* after passing through the first through hole 120. Specifically, when the external fixing plate 31 is combined onto the accommodating groove 11, a bottom of the first base plate 311 will be closed on the inner wall of the accommodating groove 11, the first side plate 312 will be closed on the avoidance groove 12, and the first inverted buckle 312*a* will be inserted into the respective first through hole 120 into the inside of the case body 10. Then the first internal fixing plate 32 is combined onto the outer side wall of the accommodating groove 11 through the inside of the case body 10, so that the second base plate 320 is closed on the outer wall surface of the accommodating groove 11. When the first internal fixing plate 32 is pushed forward horizontally, the first inverted buckle 312*a* will be snap-fitted onto the respective first buckle groove 321*a*, so that the external fixing plate 31 and the first internal fixing plate 32 are connected in a snap-fitting manner, thereby achieving the installation of the upper fixing assembly 30.

Based on the aforementioned embodiments, the second internal fixing plate 41 includes a third base plate 411 that matches in shape with the inner wall surface of the case body 10, and connecting portions 412 symmetrically disposed on both sides of the third base plate 411. The positioning hole 410 is disposed on a top of the connecting portion 412. Both ends of the inner side surface of the external fixing strip 31 are each provided with a second inverted buckle 420. A wall surface of the case body 10 is provided with a second through hole 13 that runs through the wall surface and is disposed corresponding to the second inverted buckle 420. The third base plate 411 is provided with a second buckle groove 411*a* that runs through the third base plate and is disposed corresponding to the second through hole 13. The second inverted buckle 420 is snap-fitted on the second buckle groove 411*a* after passing through the second through hole 13. Specifically, when the second internal fixing plate 41 is closed on the inner wall surface of the case body 10, a bottom of the third base plate 411 will be closed on the inner wall surface of the case body 10, and each second buckle groove 411*a* is aligned with the respective second through hole 13 on the case body 10. Then, each external fixing strip 31 is closed on an outer wall surface of the case body 10, so that each second inverted buckle 420 is snap-fitted onto the respective second buckle groove 411*a* through the second through hole 13, and thus the external fixing strip 42 and the second internal fixing plate 41 are connected in a snap-fitting manner, thereby realizing the installation of the lower fixing assembly 40.

Based on the aforementioned embodiments, two sides of the first base plate 311 are each provided with a guiding groove body 311*a*. The accommodating groove 11 is provided with a horizontal through groove 111 that runs through the accommodating groove and extends onto the avoidance groove 12. The guiding groove body 311*a* is disposed on the horizontal through groove 111. Both sides of a top of the second base plate 320 are each concavely provided with a horizontal pushing groove 320*a* extending onto the second side plate 321. The horizontal pushing groove 320*a* is disposed as matching with the guiding groove body 311*a*. The guiding groove body 311*a* is movably disposed on the horizontal pushing groove 320*a*. A bottom of the guiding groove body 311*a* is provided with a strip-shaped guiding groove 311*b* that runs through the guiding groove body. A top of the horizontal pushing groove 320*a* is provided with a guiding plate 320*b* that is disposed as matching with the strip-shaped guiding groove 311*b*. The guiding plate 320*b* is movably disposed on the strip-shaped guiding groove 311*b*. A top of the guiding plate 320*b* is provided with a position-limiting plate 320*c*. The position-limiting plate 320*c* is movably disposed in the guiding groove body 311*a*. Specifically, when the external fixing plate 31 is combined onto the accommodating groove 11, the guiding groove body 311*a* will be placed on the horizontal through groove 111, and the strip-shaped guiding groove 311*b*, the horizontal through groove 111 and the case body 10 are communicated with each other. When the first internal fixing plate 32 is combined onto the outer side wall of the accommodating groove 11, the guiding plate 320*b* and the position-limiting plate 320*c* are respectively aligned with an inside of the strip-shaped guiding groove 311*b* and the guiding groove body 311*a*, and push the first internal fixing plate 32 horizontally to move forward. The guiding plate 320*b* and the position-limiting plate 320*c* respectively enter the strip-shaped guiding groove 311*b* and the guiding groove body 311*a* through the horizontal through groove 111. The horizontal pushing groove 320*a* will move along the bottom of the guiding groove body 311*a*, until the first inverted buckle 312*a* is snap-fitted onto the first buckle groove 321*a*, which plays a guiding role to improve the assembling stability between the external fixing plate 31 and the first internal fixing plate 32 and prevent the upper fixing assembly 30 from moving on the case body 10.

Based on the aforementioned embodiments, both sides of the bottom of the first base plate 311 are each provided with a position-limiting sleeve 311*c* that is disposed as matching with the through hole 110, the guiding hole 310 is internally communicated with the position-limiting sleeve 311*c*, and the position-limiting sleeve 311*c* is disposed in the through hole 110. When the external fixing plate 31 is assembled onto the accommodating groove 11, the position-limiting sleeve 311*c* will be inserted into the respective through hole 110 to play a position-limiting role, which can improve the assembling stability of the external fixing plate 31.

The aforementioned embodiments are only descriptions of preferred embodiments of the present invention, and do not limit the scope of the present invention. Various variations and modifications made onto the technical solutions of the present invention by those of ordinary skills in the art without departing from the design spirit of the present invention, should all fall within the claimed scope determined by the claims of the present invention.

What is claimed is:

1. A structure for assembling a draw bar of a draw-bar case, the structure comprises a case body and a drawbar mechanism, the drawbar mechanism comprises a draw bar, an upper fixing assembly, and a lower fixing assembly; the draw bar comprises a handle, two movable rods are connected to both ends of the handle, and two guiding sleeves sleeved on the movable rods respectively; the upper fixing assembly comprises an external fixing plate and a first internal fixing plate; a surface of the case body is provided with an accommodating groove that matches the external fixing plate, the external fixing plate is disposed on the accommodating groove, both sides of the external fixing plate are penetrated to form a guiding hole that matches the guiding sleeve, both sides of the accommodating groove are penetrated to form a through hole that is disposed corresponding to the guiding hole, a bottom end of the guiding sleeve extends to an interior of the case body through the through hole and the guiding hole, the first internal fixing plate is disposed in the case body and snapped fit to the external fixing plate through a wall surface of the accommodating groove; the lower fixing assembly comprises a second internal fixing plate disposed in the case body and a plurality of external fixing strips disposed on an exterior of the case body, both sides of the second internal fixing plate are each provided with a positioning hole that is disposed corresponding to the guiding sleeve, the positioning hole is inserted by the bottom end of the guiding sleeve, and each external fixing strip is snapped fit to the second internal fixing plate through a wall surface of the case body.

2. The structure for assembling a draw bar of a draw-bar case according to claim 1, wherein the external fixing plate comprises a first base plate that matches in shape with the accommodating groove, a first side plate connected to one side of the first base plate, a plurality of first inverted buckles are disposed in parallel on an inner side surface of the first side plate, a bottom surface of the first base plate is adjacent to an inner side wall of the accommodating groove, the surface of the case body is provided with an avoidance groove communicated with the accommodating groove, the first side plate is disposed on the avoidance groove, the wall surface of the avoidance groove is penetrated to form a first through hole that is disposed corresponding to the first inverted buckle, the first internal fixing plate comprises a second base plate that matches in shape with an outer wall surface of the accommodating groove and a second side plate connected to one side of the second base plate, a top surface of the second base plate is adjacent to the outer wall surface of the accommodating groove, the second side plate is penetrated to form a first buckle hole that is disposed corresponding to the first through hole, and the first inverted buckle is snap-fitted onto the first buckle groove after passing through the first through hole.

3. The structure for assembling a draw bar of a draw-bar case according to claim 2, wherein the second internal fixing plate comprises a third base plate that matches in shape with an inner wall surface of the case body, and a plurality of connecting portions are symmetrically disposed on both sides of the third base plate, the positioning hole is disposed on a top of the connecting portion, both ends of an inner side surface of the external fixing strip are each provided with a second inverted buckle, a wall surface of the case body is penetrated to form a second through hole that is disposed corresponding to the second inverted buckle, the third base plate is penetrated to form a second buckle groove that is disposed corresponding to the second through hole, and the second inverted buckle is snap-fitted on the second buckle groove after passing through the second through hole.

4. The structure for assembling a draw bar of a draw-bar case according to claim 3, wherein two sides of the first base plate are each provided with a guiding groove body, the accommodating groove is penetrated to form a horizontal through groove that extends onto the avoidance groove, the guiding groove body is disposed on the horizontal through groove, both sides of a top of the second base plate are each concavely provided with a horizontal pushing groove extending onto the second side plate, the horizontal pushing groove is disposed as matching with the guiding groove body, so that the guiding groove body is movably disposed on the horizontal pushing groove, a bottom of the guiding groove body is penetrated to form a strip-shaped guiding groove, a top of the horizontal pushing groove is provided with a guiding plate that is disposed as matching with the strip-shaped guiding groove, so that the guiding plate is movably disposed on the strip-shaped guiding groove, a top of the guiding plate is provided with a position-limiting plate, and the position-limiting plate is movably disposed in the guiding groove body.

5. The structure for assembling a draw bar of a draw-bar case according to claim 4, wherein both sides of a bottom of the first base plate are each provided with a position-limiting sleeve that is disposed as matching with the through hole, the guiding hole is internally communicated with the position-limiting sleeve, and the position-limiting sleeve is disposed in the through hole.

* * * * *